US009605893B2

(12) United States Patent
Wajima et al.

(10) Patent No.: US 9,605,893 B2
(45) Date of Patent: Mar. 28, 2017

(54) HEAT SOURCE DEVICE

(75) Inventors: Kazuki Wajima, Tokyo (JP); Kenji Ueda, Tokyo (JP); Masaharu Nitta, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 611 days.

(21) Appl. No.: 13/881,281

(22) PCT Filed: Oct. 27, 2011

(86) PCT No.: PCT/JP2011/074815
§ 371 (c)(1),
(2), (4) Date: Apr. 24, 2013

(87) PCT Pub. No.: WO2012/057263
PCT Pub. Date: May 3, 2012

(65) Prior Publication Data

US 2013/0213067 A1 Aug. 22, 2013

(30) Foreign Application Priority Data

Oct. 29, 2010 (JP) ..... 2010-244067

(51) Int. Cl.
*F25B 49/00* (2006.01)
*F25B 39/04* (2006.01)
(Continued)

(52) U.S. Cl.
CPC ..... *F25D 29/008* (2013.01); *F25B 1/053* (2013.01); *F25B 5/02* (2013.01); *F25B 25/005* (2013.01);
(Continued)

(58) Field of Classification Search
CPC .. F25B 1/053; F25B 2400/13; F25B 2400/23; F25B 25/005; F25B 2700/197;
(Continued)

(56) References Cited

U.S. PATENT DOCUMENTS 2,057,101 A 10/1936 Kagi
4,972,903 A * 11/1990 Kwok ..... F28F 9/0202 165/158
(Continued)

FOREIGN PATENT DOCUMENTS

CN 1494672 A 5/2004
CN 1629495 A 6/2005
(Continued)

OTHER PUBLICATIONS

Japanese Office Action dated Sep. 24, 2014, issued in corresponding Japanese Application No. 2010-244067; w/English Translation. (9 pages).
(Continued)

*Primary Examiner* — Henry Crenshaw
(74) *Attorney, Agent, or Firm* — Westerman, Hattori, Daniels & Adrian, LLP

(57) ABSTRACT

A heat source device is provided with a differential pressure sensor that measures the differential pressure between an inlet pressure and an outlet pressure for the chilled water in an evaporator and with a control device. The control device possesses the coefficient of loss for the evaporator and is provided with a chilled-water flow-rate computing portion that calculates a chilled-water flow rate at the evaporator on the basis of the coefficient of loss and the differential pressure output from the differential pressure sensor; a control-command computing portion that generates a control command by using a specification heating-medium flow rate that is set in advance; and a control-command correcting portion that corrects the control command generated by the control-command computing portion.

12 Claims, 6 Drawing Sheets

(51) Int. Cl.

| | |
|---|---|
| ***F25D 17/02*** | (2006.01) |
| ***G05D 23/00*** | (2006.01) |
| ***G05D 17/00*** | (2006.01) |
| ***F25D 29/00*** | (2006.01) |
| ***F25B 1/053*** | (2006.01) |
| ***F25B 49/02*** | (2006.01) |
| ***F25B 5/02*** | (2006.01) |
| ***F25B 25/00*** | (2006.01) |

(52) U.S. Cl.
CPC ..... *F25B 49/02* (2013.01); *F25D 17/02* (2013.01); *F25B 2400/13* (2013.01); *F25B 2400/23* (2013.01); *F25B 2700/197* (2013.01); *F25B 2700/21161* (2013.01); *F25B 2700/21172* (2013.01); *F25B 2700/21173* (2013.01)

(58) Field of Classification Search
CPC .. F25B 2700/21161; F25B 2700/21172; F25B 2700/21173; F25B 49/02; F25B 5/02; F25D 17/02; F25D 29/008
USPC ..... 62/126, 201, 207, 206
See application file for complete search history.

(56) References Cited

U.S. PATENT DOCUMENTS

| | | | | |
|---|---|---|---|---|
| 5,083,438 | A * | 1/1992 | McMullin | G01L 3/26 165/11.1 |
| 5,594,665 | A * | 1/1997 | Walter | F04D 27/02 415/26 |
| 6,442,964 | B1 * | 9/2002 | Inoue | F25B 15/00 62/476 |
| 6,718,779 | B1 * | 4/2004 | Henry | F25B 49/027 62/183 |
| 2002/0157409 | A1 * | 10/2002 | Pham | F04C 27/005 62/228.3 |
| 2003/0078640 | A1 * | 4/2003 | Carson | A61F 7/0085 607/104 |
| 2004/0204794 | A1 | 10/2004 | Ohmi et al. | |
| 2005/0136160 | A1 * | 6/2005 | Schwichtenberg | A47F 3/001 426/241 |
| 2005/0210901 | A1 * | 9/2005 | Nash | F25B 49/022 62/228.5 |
| 2008/0034776 | A1 * | 2/2008 | Jensen | F24F 1/027 62/305 |
| 2008/0153169 | A1 * | 6/2008 | Hirata | B01F 5/0646 436/55 |
| 2009/0171512 | A1 * | 7/2009 | Duncan | F24F 5/0035 700/300 |
| 2010/0023167 | A1 | 1/2010 | Ito et al. | |
| 2010/0180629 | A1 * | 7/2010 | Ueda | F25B 49/02 62/498 |

FOREIGN PATENT DOCUMENTS

| | | | |
|---|---|---|---|
| CN | 101646905 | A | 2/2010 |
| EP | 1475684 | A1 | 11/2004 |
| JP | 08-166265 | A | 6/1996 |
| JP | 2005-090816 | A | 4/2005 |
| JP | 2005-233557 | A | 9/2005 |
| JP | 2006-038343 | A | 2/2006 |
| JP | 2008-241326 | A | 10/2008 |
| JP | 2008-256258 | A | 10/2008 |
| JP | 2009-063267 | A | 3/2009 |
| JP | 2009-204262 | A | 9/2009 |
| JP | 2010-190438 | A | 9/2010 |
| WO | 2010/113804 | A1 | 10/2010 |

OTHER PUBLICATIONS

Chinese Office Action dated Oct. 14, 2014, issued in corresponding Chinese Application No. 2011800321522.2; w/ English Translation (15 pages).
International Search Report for PCT/JP2011/074815, mailing date of Dec. 20, 2011.
Decision to Grant a Patent dated May 12, 2015, issued in counterpart Japanese Patent Application No. 2010-244067 (3 pages). Explanation of Relevance—"The Decision to Grant a Patent has been received."
Notice of Granting a Patent Right for Invention dated Oct. 15, 2015, issued in counterpart Chinese Patent Application No. 201180031522.2. Explanation of Relevance—"The Notice of Granting a Patent Right for Invention has peen received." With English translation. (4 pages).
Extended (Supplementary) European Search Report (EESR) dated Sep. 8, 2016, issued in counterpart European Patent Application No. 11836396.9. (7 pages).

* cited by examiner

HEAT SOURCE DEVICE

TECHNICAL FIELD

The present invention relates to a heat source device of, for example, a centrifugal chiller or the like.

BACKGROUND ART

For example, a centrifugal chiller has been employed for realizing district cooling/heating, cooling/heating for a semiconductor factory or the like, and so forth. FIG. 8 shows a configuration diagram of a heat source system employing a conventional centrifugal chiller. As shown in FIG. 8, a centrifugal chiller 70 cools chilled water (heating medium) supplied thereto from an external heat load 71, such as an air conditioner, a fan coil, or the like, to a predetermined temperature and supplies the cooled chilled water to the external load 71. A chilled-water pump 72 that feeds the chilled water is installed upstream of the centrifugal chiller 70 with respect to the flow of the chilled water. In addition, a chilled-water flow rate meter 73 that measures the flow rate of chilled water flowing out of the chilled-water pump 72 is provided downstream of the chilled-water pump 72. The output from this chilled-water flow rate meter 73 is sent to a control device (not shown) that controls the centrifugal chiller 70, and the centrifugal chiller 70 is controlled by using this chilled-water flow rate as one of the control parameters.

CITATION LIST

Patent Literature

{PTL 1} Japanese Unexamined Patent Application, Publication No. 2009-204262

SUMMARY OF INVENTION

Technical Problem

In a heat source system, a chilled-water flow rate meter and an electromagnetic flow rate meter are generally utilized as a chilled-water flow rate meter. However, an electromagnetic flow rate meter is expensive, and thus, adopting one sometimes is difficult. In addition, an electromagnetic flow rate meter is provided outside a centrifugal chiller, and, because data measured by the electromagnetic flow rate meter are taken into the centrifugal chiller as external data, there is a problem in that it is difficult to adjust the responsiveness etc.

Furthermore, although a centrifugal chiller is sometimes controlled by using a chilled-water flow rate estimated by using a pump characteristic curve obtained during test operation, instead of providing a chilled-water flow rate meter in a heat source system, various problems occur in the control because the estimated chilled-water flow rate is not very accurate, which forces an operator to go to the site each time to make adjustments or the like.

The present invention has been conceived in light of the above-described circumstances, and an object thereof is to provide a heat source device that, by employing a low-cost sensor, is capable of obtaining sufficiently accurate information related to the state of a heating medium, such as the heating-medium flow rate or the like, and also enhancing control accuracy.

Solution to Problem

In order to solve the above-described problems, the present invention employs the following solutions.

A first aspect of the present invention provides a heat source device comprising: a first heat exchanger that cools or heats a heating medium that flows in from an external load; a second heat exchanger that performs heat exchange with external air or cooling water; a refrigerant circulating channel that circulates refrigerant between the first heat exchanger and the second heat exchanger; a centrifugal compressor provided in the refrigerant circulating channel; a differential-pressure measuring unit that measures a differential pressure between an inlet pressure and an outlet pressure of the heating medium in the first heat exchanger; and a controlling unit, wherein the controlling unit includes a flow-rate computing unit that calculates a flow rate of the heating medium in the first heat exchanger on the basis of the coefficient of loss for the first heat exchanger and the differential pressure output from the differential-pressure measuring unit; a control-command computing unit that generates a control command by using a specification heating-medium flow rate that is set in advance; and a control-command correcting unit that corrects the control command generated by the control-command computing unit on the basis of the difference between the heating-medium flow rate calculated by the flow-rate computing unit and the specification heating-medium flow rate.

With the first aspect of the present invention, the differential pressure between the inlet pressure and the outlet pressure is measured for the heating medium at the first heat exchanger by using the differential pressure sensor, and the flow rate of the heating medium at the first heat exchanger is calculated by using the measurement data and the coefficient of loss that is specific to the first heat exchanger. Because the heat source device itself is provided with the configuration for calculating the heating-medium flow rate on the basis of the differential pressure of the heating medium in this way, it is possible to obtain a heating-medium flow rate that sufficiently satisfies the required accuracy with a low-cost, simple configuration. In addition, by correcting the control command on the basis of the current heating-medium flow rate obtained in this way, it is possible to realize automatic fine control in accordance with a heating-medium flow rate at that time.

Note that, in the heat source device according to the first aspect described above, the controlling unit may determine a correction term that depends on the time lag in measuring the outlet pressure due to the amount of heating medium held in the first heat exchanger and may correct the flow rate of the heating medium by using the correction term. In this way, because the flow rate is corrected by using the correction term that is dependent on the time lag in measuring the outlet pressure on the basis of the amount of heating medium held in the first heat exchanger, it is possible to eliminate an error on the basis of the amount of heating medium held in the first heat exchanger, and it is possible to enhance the accuracy of computing the heating-medium flow rate.

In the heat source device according to the first aspect described above, the controlling unit may include fault judging unit that judges whether or not the difference between the heating-medium flow rate calculated by the flow-rate computing unit and the specification heating-medium flow rate is equal to or greater than a predetermined threshold, which is set in advance, and for issuing an alarm, if the difference is equal to or greater than the threshold, to a monitoring device connected thereto via a communication line.

With such a configuration, it is possible to easily notify the monitoring side of the heat source system about a fault, such as an accumulation of dirt inside the heating-medium heat conducting tube in which the heating-medium is circulated, which makes it possible to perform maintenance at an appropriate time.

In the heat source device according to the first aspect described above, the flow-rate computing unit may include a first computing unit that computes the heating-medium flow rate by using sampling data from the differential-pressure measuring unit; and a second computing unit that applies smoothing processing on the sampling data from the differential-pressure measuring unit and for computing the heating-medium flow rate by using the smoothed sampling data, wherein the fault judging unit may perform fault judgment by using the heating-medium flow rate calculated by the first computing unit, and the control-command correcting unit may correct the control command by using the heating-medium flow rate calculated by the second computing unit.

With such a configuration, a fault is detected by the fault judging unit on the basis of the heating-medium flow rate calculated on the basis of the sampling data from the differential-pressure measuring unit, and the control command is corrected by the control-command correcting unit on the basis of the heating-medium flow rate calculated from the data whose fluctuation range is reduced by applying smoothing processing to the sampling data from the differential-pressure measuring unit. Accordingly, with a single differential pressure sensor, it is possible to detect a stoppage, where the flow rate suddenly changes, and it is also possible to realize stable control.

A second aspect of the present invention provides a heat source device comprising: a first heat exchanger that cools or heats a heating medium that flows in from an external load; a second heat exchanger that performs heat exchange with external air or cooling water; a refrigerant circulating channel that circulates refrigerant between the first heat exchanger and the second heat exchanger; a centrifugal compressor provided in the refrigerant circulating channel; a differential-pressure measuring unit that measures a differential pressure between the inlet pressure and the outlet pressure of the heating medium in the first heat exchanger; a flow-rate measuring unit that measures a flow rate of the heating medium in the first heat exchanger; a temperature measuring unit that measures a temperature of the heating medium to be input to the first heat exchanger; and a controlling unit, wherein the controlling unit includes a heating-medium concentration computing unit that calculates a specific weight of the heating medium based on the differential pressure output from the differential-pressure measuring unit, the heating-medium flow rate output from the flow-rate measuring unit, and the coefficient of pressure loss for the first heat exchanger, and for calculating the heating-medium concentration by using the specific weight of the heating medium, the heating-medium temperature measured by the temperature measuring unit, and information related to the physical properties of the heating medium; a control-command computing unit that generates a control command by using a specification heating-medium concentration that is set in advance; and a control-command correcting unit that corrects the control command generated by the control-command computing unit on the basis of the difference between the heating-medium concentration calculated by the flow-rate computing unit and the specification heating-medium concentration.

With the second aspect of the present invention, the differential pressure between the inlet pressure and the outlet pressure is measured for the heating medium at the first heating exchanger by using the differential pressure sensor, and the concentration of the heating medium at the first heat exchanger is calculated by using the measurement data. Because the heat source device itself is provided with the configuration for calculating the heating-medium concentration on the basis of the heating-medium differential pressure in this way, it is possible to obtain a heating-medium concentration that sufficiently satisfies the required accuracy with a low-cost, simple configuration. In addition, by correcting the control command on the basis of the current heating-medium concentration obtained in this way, it is possible to realize automatic fine control in accordance with a heating-medium concentration at that time.

In the heat source device according to the second aspect described above, the controlling unit may include a unit of calculating an amount of heat exchanged at the first heat exchanger by substituting current power consumption at the centrifugal compressor and the amount of heat exchanged at the second heat exchanger into a relational expression that expresses the relationship between the power consumption at the centrifugal compressor, the amount of heat exchanged at the first heat exchanger, and the amount of heat exchanged at the second heat exchanger, and for calculating the heating-medium flow rate on the basis of the calculated amount of heat exchanged at the first heat exchanger.

With such a configuration, because the heating-medium flow rate is obtained by using the relational expression described above, even in the case in which differential pressure cannot be detected because the differential-pressure measuring unit has failed, a detection limit has been exceeded, and so forth, the heating-medium flow rate can be obtained, and control can be performed continuously.

In the heat source device according to the second aspect described above, the controlling unit may include a relational expression in which the relationship between the heating-medium flow rate and the performance of the heat exchanger is expressed and may include a unit of determining the performance of the heat exchanger for the heating-medium flow rate calculated by the flow-rate computing unit on the basis of the relational expression and for detecting a performance deterioration of the heat exchanger.

With such a configuration, because a performance deterioration of the heat exchanger is detected on the basis of the heating-medium flow rate, it is possible to quickly take appropriate measures against the performance deterioration of the heat exchanger.

Advantageous Effects of Invention

With the present invention, an advantage is afforded in that, by employing a low-cost sensor, a sufficiently accurate heating-medium flow rate can be obtained, and control accuracy can also be enhanced.

DESCRIPTION OF EMBODIMENTS

Individual embodiments will be described below by using the drawings for a case in which a centrifugal chiller is employed as a heat source device of the present invention.

First Embodiment

Figure 1:
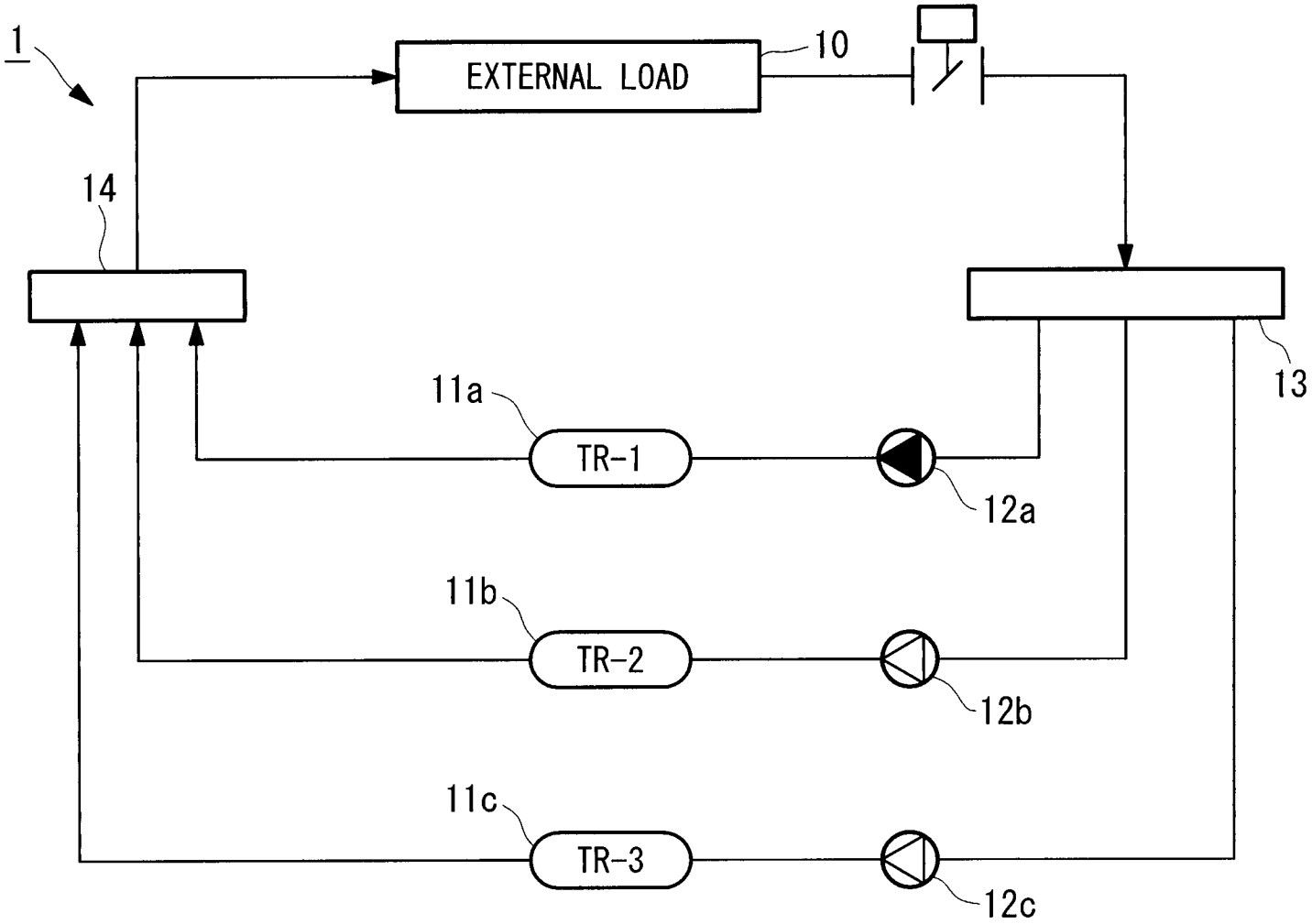
FIG. 1 is a diagram showing, in outline, the configuration of a heat source system according to a first embodiment of the present invention.

FIG. 1 shows, in outline, the configuration of a heat source system according to a first embodiment of the present invention. A heat source system 1 is provided with, for example, three centrifugal chillers (heat source devices) 11*a*, 11*b*, and 11*c* that are installed in a building or factory equipment and that take away heat from chilled water (heating medium) to be supplied to an external load 10, such as an air conditioner, a fan coil, or the like. These centrifugal chillers 11*a*, 11*b*, and 11*c* are installed in parallel with the external load 10.

Chilled water pumps 12*a*, 12*b*, and 12*c* that feed the chilled water are installed upstream, with respect to the flow of the chilled water, of the centrifugal chillers 11*a*, 11*b*, and 11*c*, respectively. The chilled water is sent to the individual centrifugal chillers 11*a*, 11*b*, and 11*c* from a return header 13 by means of the chilled water pumps 12*a*, 12*b*, and 12*c*. The individual chilled-water pumps 12*a*, 12*b*, and 12*c* are driven by inverter motors, and, by doing so, the rotational speed is made variable, enabling variable flow-rate control.

The chilled water obtained at the individual centrifugal chillers 11*a*, 11*b*, and 11*c* is collected at a supply header 14. The chilled water collected at the supply header 14 is supplied to the external load 10. The chilled water whose temperature has been increased by being used for air conditioning or the like at the external load 10 is sent to the return header 13. The chilled water is branched at the return header 13 and is sent to the individual centrifugal chillers 11*a*, 11*b*, and 11*c*.

Figure 2:
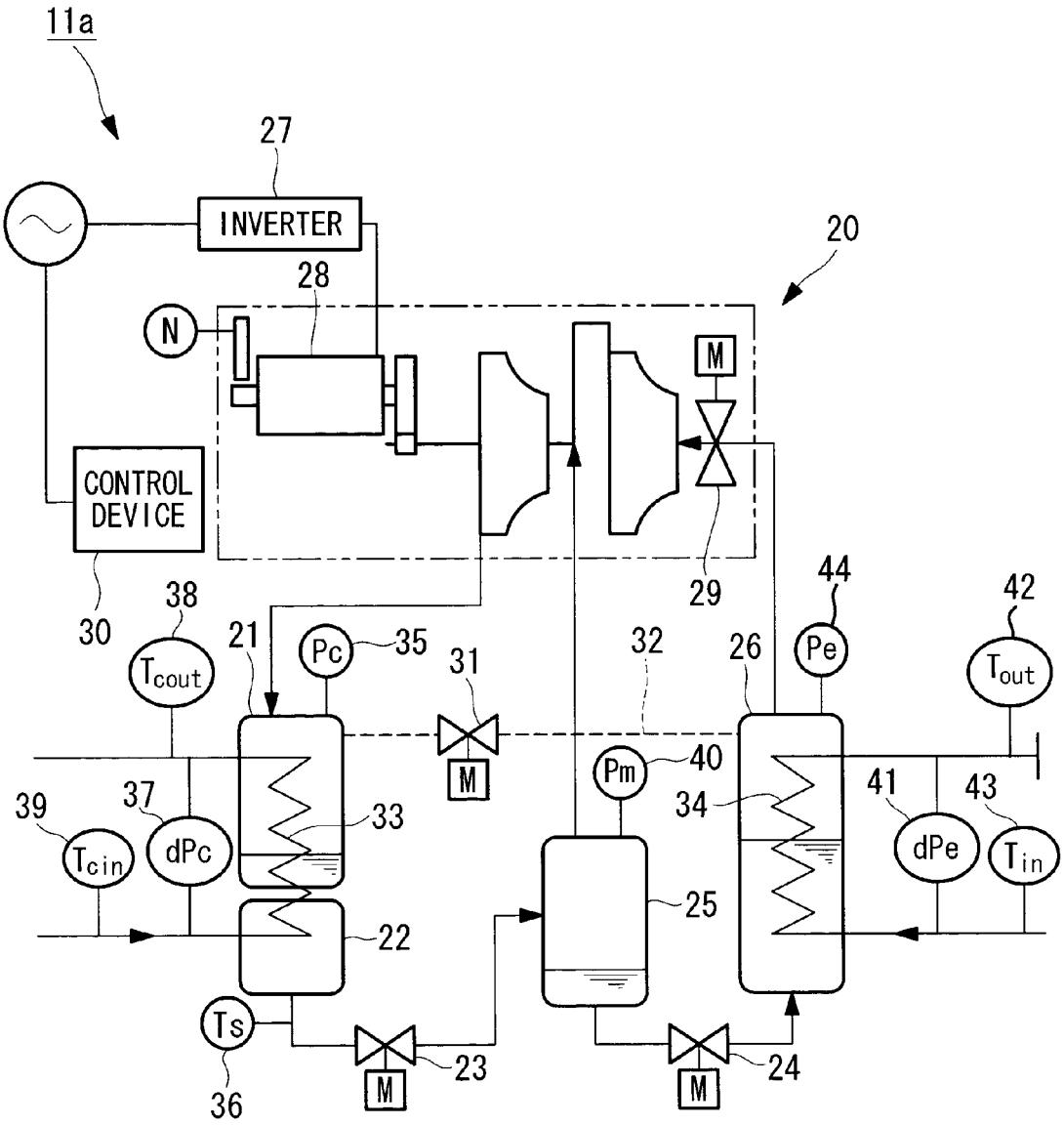
FIG. 2 is a diagram showing, in outline, the configuration of a centrifugal chiller according to the first embodiment of the present invention.

Next, the above-described centrifugal chillers will be described. Because the individual centrifugal chillers 11*a*, 11*b*, and 11*c* have the same configuration, the centrifugal chiller 11*a* will be described. FIG. 2 is a diagram showing, in outline, the configuration of the centrifugal chiller 11*a*.

The centrifugal chiller 11*a* is provided with a centrifugal compressor 20 that compresses refrigerant; a condenser (second heat exchanger) 21 that condenses high-temperature, high-pressure gaseous refrigerant compressed by the centrifugal compressor 20; a subcooler 22 that supercools liquid refrigerant condensed at the condenser 21; a high-pressure expansion valve 23 that causes the liquid refrigerant from the subcooler 22 to expand; an intermediate cooling unit 25 that is connected to the high-pressure expansion valve 23, an intermediate stage of the centrifugal compressor 20, and a low-pressure expansion valve 24; and an evaporator (first heat exchanger) 26 that evaporates the liquid refrigerant expanded at the low-pressure expansion valve 24.

The centrifugal compressor 20 is a centrifugal two-stage compressor and is driven by an electrical motor 28 whose rotational speed is controlled by an inverter 27. The output power of the inverter 27 is controlled by a control device 30. Note that the centrifugal compressor 20 may be a fixed-speed compressor having a constant rotational speed. At a refrigerant suction port of the centrifugal compressor 20, an inlet guide vane (hereinafter, referred to as "IGV") 29 that controls the flow rate of the refrigerant to be sucked thereinto is provided, which makes it possible to perform capacity control for the centrifugal chiller 11*a*.

The condenser 21 is provided with a pressure sensor 35 for measuring the condenser pressure (condensed refrigerant pressure). An output Pc from the pressure sensor 35 is sent to the control device 30.

Downstream of the condenser 21 with respect to the refrigerant flow, the subcooler 22 is provided so as to supercool the condensed refrigerant. Immediately downstream of the subcooler 22 with respect to the refrigerant flow, a temperature sensor 36 that measures a supercooled refrigerant temperature Ts is provided.

A cooling heat-conducting tube 33 for cooling the condenser 21 and the subcooler 22 is inserted thereinto so as to pass through them. A cooling-liquid flow rate is determined by means of computation on the basis of an inlet-outlet differential pressure of the chilled water measured by a differential pressure sensor 37; a cooling-water outlet temperature Tcout is measured by a temperature sensor 38; and a cooing-water inlet temperature Tcin is measured by a temperature sensor 39. The cooling water externally exhausts heat at a cooling tower (not shown), after which it is guided to the condenser 21 and the subcooler 22 again.

The intermediate cooling unit 25 is provided with a pressure sensor 40 for measuring an intermediate pressure Pm.

A differential pressure sensor 41 for measuring an inlet-outlet differential pressure dPe of the chilled water is provided at chilled-water inlet/outlet of the evaporator 26. Chilled water of a rated temperature (for example, 7° C.) is obtained by means of heat absorption at the evaporator 26. A chilled-water heat conducting tube 34 for cooling the chilled water to be supplied to the external load 10 (see FIG. 1) is inserted into the evaporator 26 so as to pass therethrough. A chilled-water outlet temperature Tout is measured by a temperature sensor 42; a chilled-water inlet temperature Tin is measured by a temperature sensor 43; and an evaporator pressure Pe is measured by a pressure sensor 26.

A hot-gas bypass pipe 32 is provided between a gas phase in the condenser 21 and a gas phase in the evaporator 26. Then a hot-gas bypass valve 31 for controlling the flow rate of the refrigerant that flows inside the hot-gas bypass pipe 32 is provided. By adjusting the hot-gas bypass flow rate by means of the hot-gas bypass valve 31, capacity control becomes possible in an extremely low load region where the control by the IGV 29 is not sufficient.

In addition, for the centrifugal chiller 11*a* shown in FIG. 2, a description is given for a case in which the condenser 21 and the subcooler 22 are provided and the cooling water is heated by performing heat exchange between the refrigerant and the cooling water that has externally exhausted heat at the cooling tower; however, for example, an air heat exchanger may be provided instead of the condenser 21 and the subcooler 22, and heat exchange may be performed between the external air and the refrigerant at the air heat exchanger.

Furthermore, the centrifugal chiller 11*a* employed in this embodiment is not limited to a centrifugal chiller having only the cooling function described above, and, for example, it may have only the heating function or both the cooling function and the heating function.

In FIG. 2, measurement data measured by the individual sensors are transmitted to the control device 30, and various types of control are performed at the control device 30 on the basis of the measurement data. The control device 30 is formed of, for example, a CPU (central processing unit), a ROM (Read Only Memory), a RAM (Random Access Memory), and so on. Steps of a processing sequence for realizing various functions, described later, are recorded in the ROM or the like in the form of a program, and the CPU loads this program into the RAM or the like and executes information processing and computational processing, thereby realizing various functions to be described later.

Figure 3:
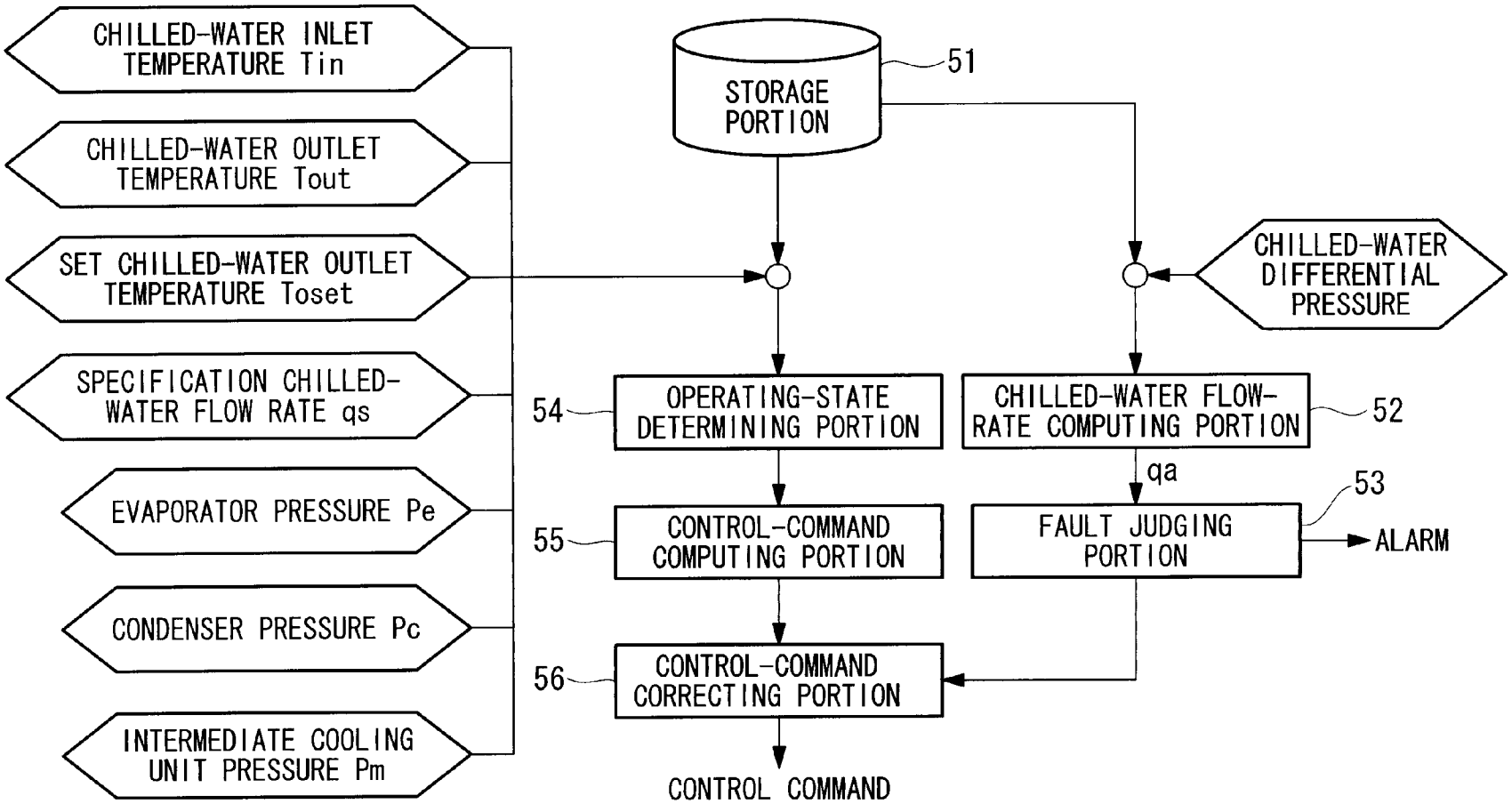
FIG. 3 is a functional block diagram of a control device according to the first embodiment of the present invention.

FIG. 3 is a functional block diagram showing, in an expanded manner, the functions the control device 30 is provided with. As shown in FIG. 3, the control device 30 is provided with, as main components, a storage portion 51, a chilled-water flow-rate computing portion 52, a fault judging portion 53, an operating-state determining portion 54, a control-command computing portion 55, and a control-command correcting portion 56.

Various information related to the centrifugal chiller that is necessary for the individual portions described above to perform the computations is saved in the storage portion 51.

The chilled-water flow-rate computing portion 52 possesses, for example, Equation (1) below, and calculates a chilled-water flow rate qa by substituting the measured value dPe from the differential pressure sensor 41 into this Equation. In Equation (1), ζ is a coefficient of loss for the evaporator 26, which is stored in, for example, the storage portion 51.

{Eq. 1}

$$qa=\xi\sqrt{dPe} \tag{1}$$

In addition, for example, the data measured by the differential pressure sensor 41 include disturbances due to opening, closing, or the like of various valves provided in a refrigerant circulation path of the centrifugal chiller 11. Therefore, in order to reduce fluctuations in sampling data due to such disturbances, the chilled-water flow-rate computing portion 52 may apply smoothing processing to the sampling data measured by the differential pressure sensor 41, by using a technique such as a moving average, and may calculate the chilled-water flow rate qa from Equation (1) above by using the processed data.

Furthermore, for example, the chilled-water flow-rate computing portion 52 may calculate the chilled-water flow rate qa by using a computational equation in which a correction term with regard to the temperature dependency of the chilled-water flow rate qa in the evaporator 26 is additionally reflected in Equation (1) above.

In addition, because the evaporator 26 in the centrifugal chiller 11 is large, the amount of liquid held therein is also large. Because of this, there is a time lag between the pressure at the chilled-water inlet of the evaporator 26 and the pressure at the chilled-water outlet thereof in accordance with the amount of liquid held therein. Therefore, at the chilled-water flow-rate computing portion 52, the chilled-water flow rate qa may be calculated by using a computational equation in which a correction term on the basis of the amount of liquid held in the evaporator 26 is added to Equation (1) above in order to eliminate an error in the differential pressure due to this time lag.

The fault judging portion 53 calculates a difference between the chilled-water flow rate qa computed by the chilled-water flow-rate computing portion 42 and a specification chilled-water flow rate qs, which is set in advance, and when this difference is equal to or greater than a predetermined threshold, which is set in advance, the fault judging portion 53 notifies, by means of an alarm, a monitoring device of the heat source system to which it is connected via a communication line.

The operating-state determining portion 54 determines the current operating state by using various information related to the centrifugal chiller saved in the storage portion 51, as well as input data measured by the individual sensors, such as, for example, the chilled-water inlet temperature Tin, the chilled-water outlet temperature Tout, a set chilled-water outlet temperature Toset, the specification chilled-water flow rate qs, the evaporator pressure Pe, the condenser pressure Pc, the intermediate cooling-unit pressure Pm, and so forth. The control-command computing portion 55 generates individual control commands on the basis of the operating state determined by the operating-state determining portion 54. Note that, because the processing performed by the operating-state determining portion 54 and the control-command computing portion 55 is known processing, details thereof are omitted.

The control-command correcting portion 56 calculates a correction value for correcting the control commands for the centrifugal chiller on the basis of the difference between the chilled-water flow rate qa and the specification chilled-water flow rate qs and corrects the control commands determined by the control-command computing portion 55 by using this correction value. For example, the control-command correcting portion 56 possesses a computational equation for obtaining a correction value in which the difference between the chilled-water flow rate qa and the specification chilled-water flow rate qs serves as a variable and obtains a correction value by substituting the difference calculated at the fault judging portion 53 into this computational equation. With this correction value, for example, a command value to be provided for controlling the rotational speed of an electric motor is corrected.

With the control device 30 having such a configuration, for example, the chilled-water flow rate computing portion 52 calculates the chilled-water flow rate qa from Equation (1) above by using the data dPe measured by the differential pressure sensor 41; and the fault judging portion 53 determines the difference between the calculated chilled-water flow rate qa and the specification chilled-water flow rate qs, which is set in advance, judges whether or not this difference is equal to or greater than the predetermined threshold, which is set in advance, and notifies, by means of an alarm, the monitoring device of the heat source system if the difference is equal to or greater than the threshold. Accordingly, for example, it is possible to easily notify the monitoring side of the heat source system about a fault such as an accumulation of dirt inside the chilled-water heat conducting tube 34 (see FIG. 2), which makes it possible to perform maintenance at an appropriate time. In addition, the operating-state determining portion 54 determines the current operating state by using the predetermined information saved in the storage portion 51, as well as sensor values such as the chilled-water inlet temperature Tin and so forth; and the control-command computing portion 55 generates the individual control commands on the basis of the current operating state and provides the control-command correcting portion 56 with the generated control commands. The control-command correcting portion 56 calculates the correction values for correcting the control commands for the centrifugal chiller on the basis of the difference between the chilled-water flow rate qa and the specification chilled-water flow rate qs, and the control commands determined by the control-command computing portion 55 are corrected by using the correction values. The control commands corrected by the control-command correcting portion 56 are provided to the individual components to be controlled, and, by doing so, control is performed on the basis of the chilled-water flow rate qa calculated on the basis of the chilled-water differential pressure dPe.

As has been described above, with the centrifugal chiller according to this embodiment, because the centrifugal chiller itself is provided with the configuration for calculating the chilled-water flow rate on the basis of the chilled-water differential pressure, it is possible to obtain a chilled-water flow rate that sufficiently satisfies the required accuracy with a low-cost, simple configuration. In addition, by correcting control commands on the basis of a current chilled-water flow rate obtained in this way, it is possible to realize automatic fine control in accordance with the chilled-water flow rate at that time.

Figure 8:
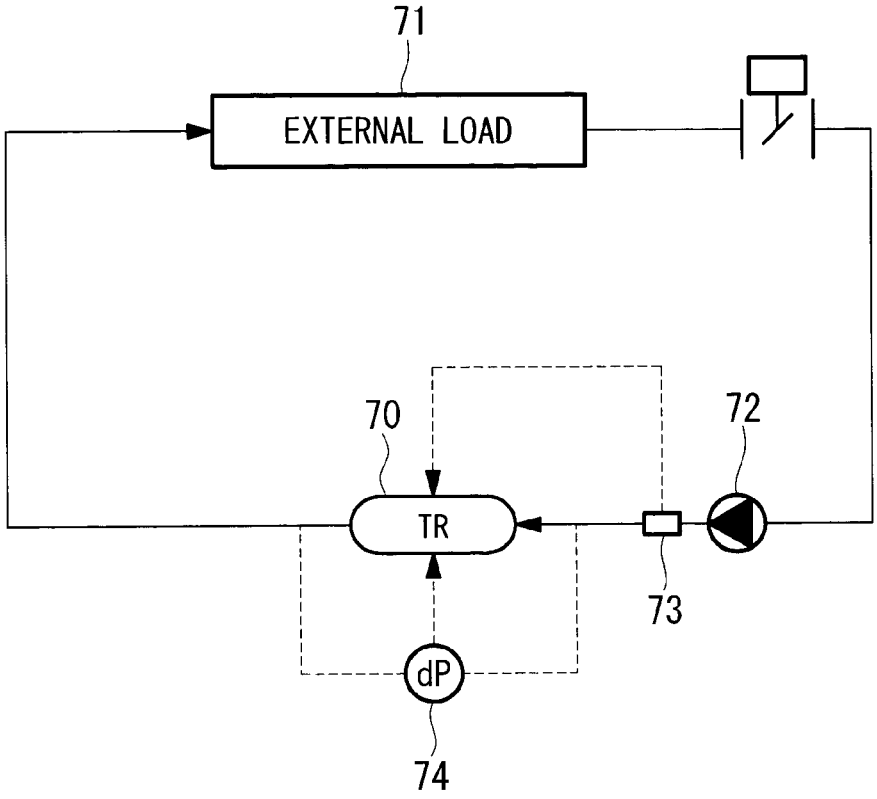
FIG. 8 is a diagram showing, in outline, the configuration of a conventional heat source system.

In addition, as shown in FIG. 8, for reasons described below, in a general conventional heat source system, for example, a protection function sensor 74 is provided in addition to an electromagnetic flow rate meter 73 or the like for measuring a flow rate to be used in controlling a centrifugal chiller 70, so that, when stoppage, freezing, and so forth of the chilled water occurs, the fault can quickly be detected, and thus, the state of the chilled water is monitored by the two sets of sensors. In other words, because the data measured by the electromagnetic flow rate meter 73 fluctuate due to disturbances such as opening and closing of valves or the like, the control of the centrifugal chiller 70 becomes unstable if the data are used without modification. Therefore, with the conventional heat source system, for example, the sampling data measured by the electromagnetic flow rate meter 73 is subjected to smoothing processing at an adjusting circuit (not shown) to reduce the fluctuations, and the chilled-water flow rate data whose fluctuations have been reduced are sent to a control device (not shown) in the centrifugal chiller 70. However, there is a problem in that, with the smoothed sampling data, it is not possible to reliably detect a phenomena in which flow rate suddenly changes, such as a stoppage. A fault detecting sensor is separately provided in order to eliminate this problem, and a fault such as a stoppage or the like is detected on the basis of data from this fault detecting sensor.

Figure 4:
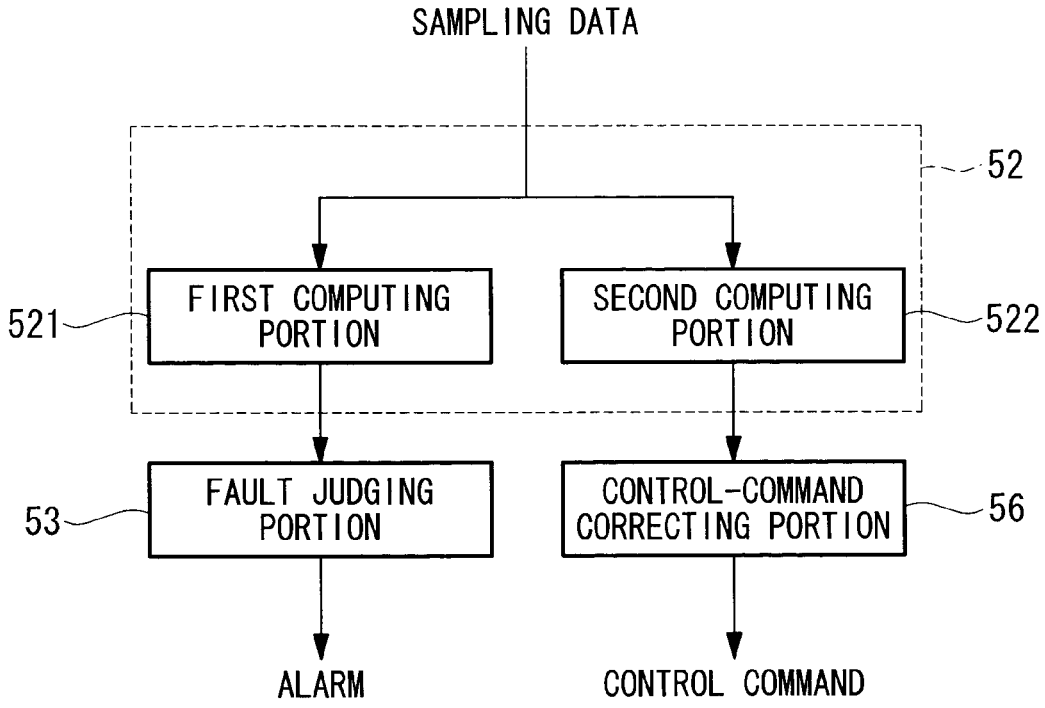
FIG. 4 is a diagram showing an example configuration of a chilled-water flow-rate computing portion of the control device.

In contrast, with this embodiment, because the centrifugal chiller 11*a* itself has the differential pressure sensor 41 as described above, by storing the property data or the like for this differential pressure sensor 41 in the control device 30, the sampling data from the differential pressure sensor 41 can be adjusted at the control device 30 in accordance with the usage thereof. In other words, as shown in FIG. 4, with this embodiment, the chilled-water flow-rate computing portion 52 may be provided with a first computing portion 521 that computes the chilled-water flow rate by using the sampling data from the differential pressure sensor 41 without modification and a second computing portion 522 that applies known smoothing processing, such as a moving average, to the sampling data from the differential pressure sensor 41 and that calculates the chilled-water flow rate on the basis of the processed data; the fault judging portion 53 may detect a fault on the basis of the chilled-water flow rate calculated by the first computing portion 521; and the control-command correcting portion 56 may correct the control commands on the basis of the chilled-water flow rate calculated by the second computing portion 522. By doing so, the two purposes, that is, control of the centrifugal chiller and detection of a fault, can be achieved by a single differential pressure sensor 41, and it is possible to eliminate installation of two sets of sensors such as those shown in FIG. 8.

Figure 5:
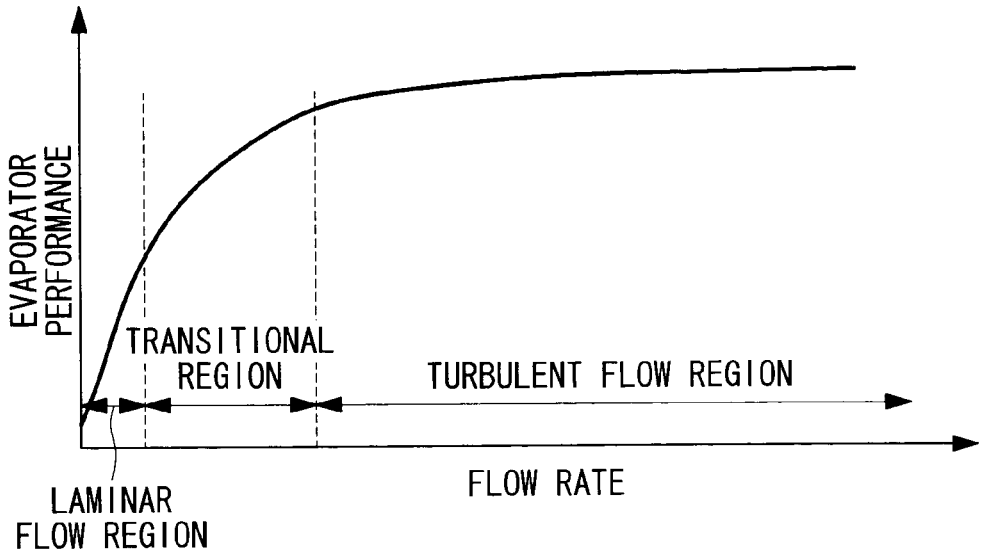
FIG. 5 is a diagram showing the relationship between evaporator performance and flow rate.

In addition, for example, the performance of the evaporator 26 depends on the chilled-water flow rate qa and varies greatly, for example, depending on the flow-rate conditions such as a turbulent flow region, a transitional region, a laminar flow region and so forth, as shown in FIG. 5. Therefore, the control device 30 may be additionally provided with a function for notifying, by means of an alarm, the monitoring device of the heat source system or a function for performing an appropriate protective control operation, by which the performance of the evaporator is judged to be deteriorating when the chilled-water flow rate is equal to or less than a predetermined threshold, which is set in advance, or when the chilled-water flow rate is detected to be continuously decreasing over a predetermined period. With the centrifugal chiller 11*a* according to this embodiment, by additionally providing the control device 30 with a function for detecting performance deterioration of the evaporator 26 on the basis of the chilled-water flow rate qa in this way, it is possible to quickly take appropriate measures.

Furthermore, in this embodiment, although the chilled water has been described as an example of a heating medium, it is not limited to this example, and, for example, brine (for example, antifreeze such as ethylene glycol, etc.) or the like may be employed.

Second Embodiment

Next, a centrifugal chiller according to a second embodiment of the present invention will be described. The centrifugal chiller according to this embodiment is employed in a heat source system in which brine (for example, antifreeze such as ethylene glycol, etc.) is utilized as a heating medium instead of chilled water; the brine concentration is calculated instead of the chilled-water flow rate; and the control commands for the centrifugal chiller are corrected by using the calculated brine concentration. In the following, the centrifugal chiller of this embodiment will be described with reference to FIG. 6.

Figure 6:
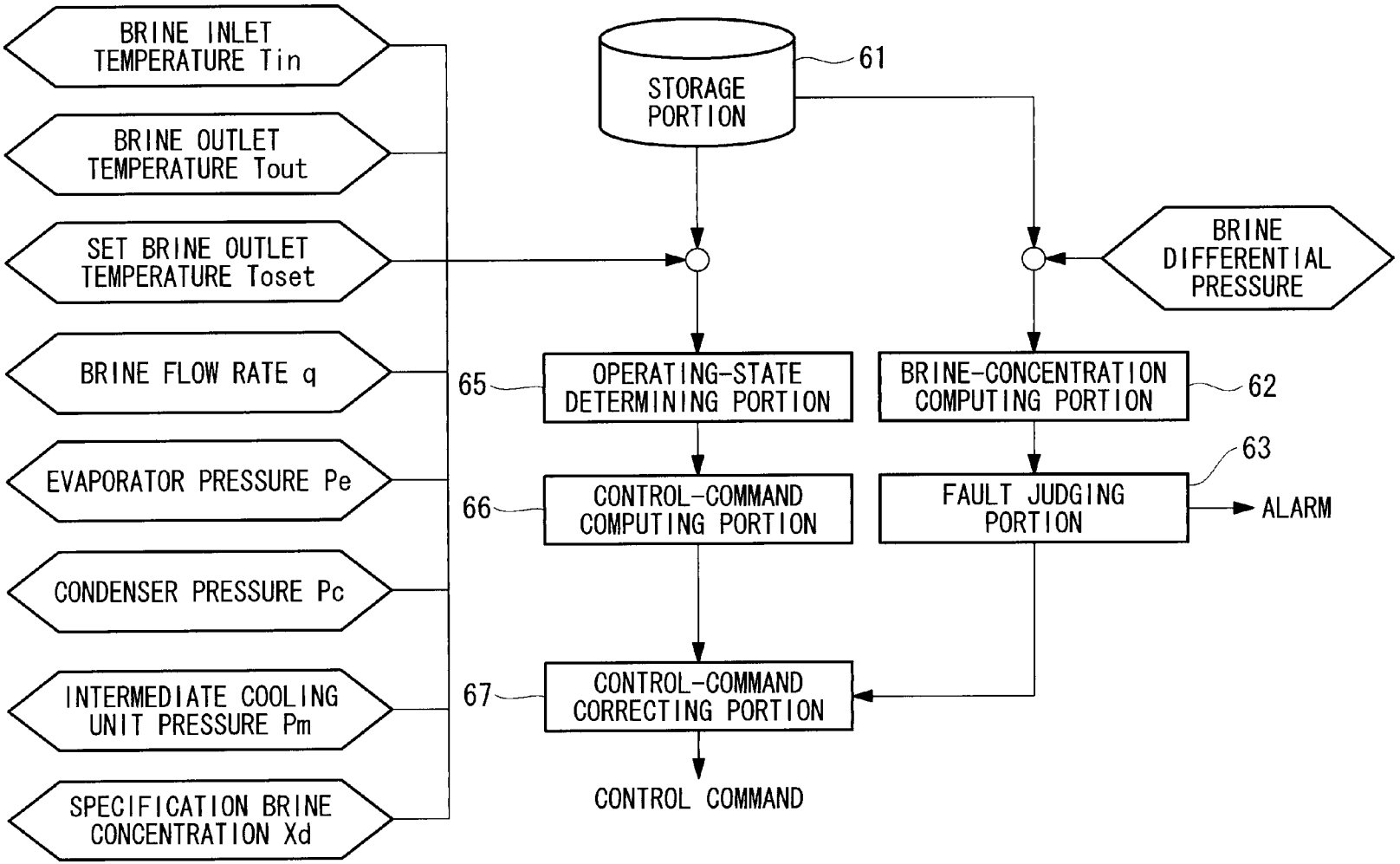
FIG. 6 is a functional block diagram of a control device according to a second embodiment of the present invention.

FIG. 6 is a functional block diagram of a control device according to this embodiment. As shown in FIG. 6, the control device according to this embodiment is provided with, as main components, a storage portion 61, a brine-concentration computing portion 62, a fault judging portion 63, an operating-state determining portion 65, a control-command computing portion 66, and a control-command correcting portion 67. In addition, in this embodiment, a brine differential pressure is measured by the differential pressure meter 41 in the evaporator 26 in FIG. 2. In addition, information related to the centrifugal chiller that is necessary for the individual portions described above to perform computations, data about the physical properties of the brine, and so forth are saved in the storage portion 61.

The brine-concentration computing portion 62 calculates the brine concentration on the basis of the brine differential pressure. Equation (2) and Equation (3) below are used to calculate the brine concentration.

$$X=f(\rho,T) \quad (2)$$

$$\rho=f(q,\Delta P) \quad (3)$$

The brine concentration X is determined from the specific weight ρ of the brine, the average temperature T between an inlet temperature Tin and an outlet temperature Tout of the brine, and physical properties of the brine saved in the storage portion 61. In addition, the specific weight ρ of the brine is calculated on the basis of a brine flow rate q measured by a separately provided flow rate meter (not shown) or the like, a brine differential pressure measured by the differential pressure meter 41, and pressure-loss characteristics or the like saved in the storage portion 61. The fault judging portion 63 calculates the difference between the brine concentration computed by the brine-concentration computing portion 62 and a specification brine concentration, which is set in advance, and, if this difference is equal to or greater than a predetermined threshold that is set in advance, the fault judging portion 63 notifies, by means of an alarm, a monitoring device of the heat source system to which it is connected via a communication line.

The operating-state determining portion 65 determines the current operating state by using various kinds of information about the centrifugal chiller saved in the storage portion 61, as well as input data measured by the individual sensors, such as, for example, the brine inlet temperature Tin, the brine outlet temperature Tout, a set brine outlet temperature Toset, the brine flow rate q, the evaporator pressure Pe, condenser pressure Pc, the intermediate cooling-unit pressure Pm, and so forth. The control-command computing portion 66 generates individual control commands on the basis of the operating state determined by the operating-state determining portion 56. Note that, because processing performed by the operating-state determining portion 65 and the control-command computing portion 66 involves generation of control commands on the basis of the individual sensor values, which is known processing, details thereof are omitted.

The control-command correcting portion 67 calculates a correction value for correcting the control commands for the centrifugal chiller on the basis of the current brine concentration determined by the brine-concentration computing portion 62 and corrects the control commands determined by the control-command computing portion 66 by using this correction value. For example, the control-command correcting portion 67 possesses a computational equation for obtaining a correction value in which the brine concentration serves as a variable and obtains a correction value by substituting the brine concentration calculated at the brine-concentration computing portion 62 into this computational equation. For example, a command value to be provided for controlling the rotational speed of an electric motor is corrected by the control-command correcting portion 67.

With the control device provided with such a configuration, the brine-concentration computing portion 62 calculates the brine concentration; and the fault judging portion 63 judges whether or not the difference between the calculated brine concentration and the specification brine concentration, which is set in advance, is equal to or greater than the predetermined threshold, which is set in advance, and notifies the monitoring device of the heat source system about a fault via the communication line if the threshold is reached or exceeded. Accordingly, at a monitoring facility on the heat source system side, it is possible to recognize the risk of freezing or the like due to a decrease in the brine concentration. In addition, when a fault is not detected, the current brine concentration calculated by the brine-concentration computing portion 62 is output to the control-command correcting portion 67.

In addition, the operating-state determining portion 65 determines the current operating state by using the predetermined information saved in the storage portion 61, as well as sensor values such as the brine inlet temperature Tin and so forth; and the control-command computing portion 66 generates the individual control commands on the basis of the current operating state and provides the control-command correcting portion 67 with the generated control commands. The control-command correcting portion 67 calculates the correction value for correcting the control commands for the centrifugal chiller by using the current brine concentration, and the control commands determined by the control-command computing portion 66 are corrected by using this correction value. The control command values corrected by the control-command correcting portion 67 are provided to the individual components to be controlled, and, by doing so, control is performed on the basis of the brine concentration calculated on the basis of the brine differential pressure.

As has been described above, with the centrifugal chiller according to this embodiment, because the centrifugal chiller itself is provided with the configuration for calculating the brine concentration on the basis of the brine differential pressure, it is possible to obtain a brine concentration that sufficiently satisfies the required accuracy with a low-cost, simple configuration. In addition, because the alarm is issued when the difference between the actual brine concentration and the specification concentration thereof exceeds the predetermined threshold, it is possible to notify, by means of this alarm, operators on the heat source system side about the risk of freezing or the like due to a decrease in the brine concentration. Note that, in the case in which a flow rate meter is not provided and the brine concentration is detected by other means, a fault may be detected on the basis of whether or not the brine flow rate is within a predetermined range, instead of the brine concentration.

In addition, with the centrifugal chiller according to this embodiment, the control commands on the basis of the actual brine concentration can be employed when the brine concentration is within a normal range, and it is possible to realize automatic fine control in accordance with the brine conditions.

Note that the centrifugal chiller according to the second embodiment may also be provided with the functions of the first computing portion 521 and the second computing portion 522 shown in FIG. 4, or the function for detecting a performance deterioration of the evaporator 26 shown in FIG. 5.

Third Embodiment

With the first embodiment and the second embodiment described above, the heating-medium differential pressure of chilled water or brine is measured, and the heating-medium flow rate is determined on the basis of this differential pressure; however, for example, if the differential pressure meter 41 that measures the heating-medium differential pressure fails, there will be a problem in calculating the flow rate. In this embodiment, in the case in which differential pressure cannot be detected because the differential pressure meter has failed, a detection limit has been exceeded, and so forth, a heating-medium flow rate is calculated by means of computation on the basis of a heat-balance relational expression for the centrifugal chiller.

For example, in a centrifugal chiller, the power consumption Qm of the centrifugal compressor 20, the amount of exchanged heat Qe for the evaporator 26, and the amount of exchanged heat Qc for the condenser 21 satisfy a relational expression expressed by Equation (4) below.

$$Qe+Qm=Qc \tag{4}$$

In Equation (4) above, Qe is the amount of heat exchanged at the evaporator, Qm is the power consumed by the centrifugal compressor, and Qc is the amount of heat exchanged at the condenser.

Qe and Qc can be determined by the following Equation (5) and Equation (6), respectively.

$$Qe=Cpe\cdot\rho e\cdot qe\cdot(T\text{out}-T\text{in}) \tag{5}$$

In Equation (5) above, Cpe is the specific heat [kJ/(kg·K)] of the heating medium; ρe is the density [kg/m$^3$] of the heating medium; qe is the volumetric flow rate [m$^3$/s] of the heating medium; Tout is the outlet temperature [K] of the heating medium measured by the temperature sensor 42 in FIG. 2; and Tin is the inlet temperature [K] of the heating medium measured by the temperature sensor 43 in FIG. 2.

$$Qc=Cpc\cdot\rho c\cdot qc\cdot(T\text{cout}-T\text{cin}) \tag{6}$$

In Equation (6), Cpc is the specific heat [kJ/(kg·K)] of the cooling water; ρc is the density [kg/m$^3$] of the cooling water; qc is the volumetric flow rate [m$^3$/s] of the cooling water computed on the basis of outlet-inlet differential pressure of the cooling water measured by the differential pressure sensor 37 in FIG. 2; Tcout is the outlet temperature [K] of the cooling water measured by the temperature sensor 38 in FIG. 2; and Tcin is the inlet temperature [K] of the cooling water measured by the temperature sensor 39 in FIG. 2.

In addition, the power consumption Qm is constantly measured by the control device.

In this way, in this embodiment, when the differential pressure meter 41 (see FIG. 2) fails, the flow rate of the heating medium can be obtained by calculating the flow rate of the heating medium by means of computation from the relational expression expressed by Equation (4) above. Accordingly, for example, even in the case in which differential pressure cannot be detected because the differential pressure sensor 41 has failed, the detection limit has been exceeded, and so forth, the heating-medium flow rate can be obtained, and control can be performed continuously.

In addition, by using the relational expression above, the flow rate of the cooling water can be calculated even when the sensor on the cooling water side fails. In general, because the cooling water is in an open system that passes through a cooling tower or the like, as compared with a heating-medium heat conducting tube forming a closed system, dirt easily accumulates in the cooling heat conducting tube 33 in which the cooling water circulates, which tends to lower the accuracy of measuring the flow rate of the cooling water; however, in this case, the flow rate of the cooling water can be obtained with sufficient accuracy by using the relational expression above. Note that, when the relational expression above is not satisfied, the heating-medium flow rate is compared with the specification heating-medium flow rate, which is set in advance, in order to identify for which of the heating-medium flow rate and the cooling-water flow rate a fault is occurring, and, if the error thereof is within a predetermined range, it can be judged that a failure or the like has occurred in the flow rate sensor for the cooling water.

Figure 7:
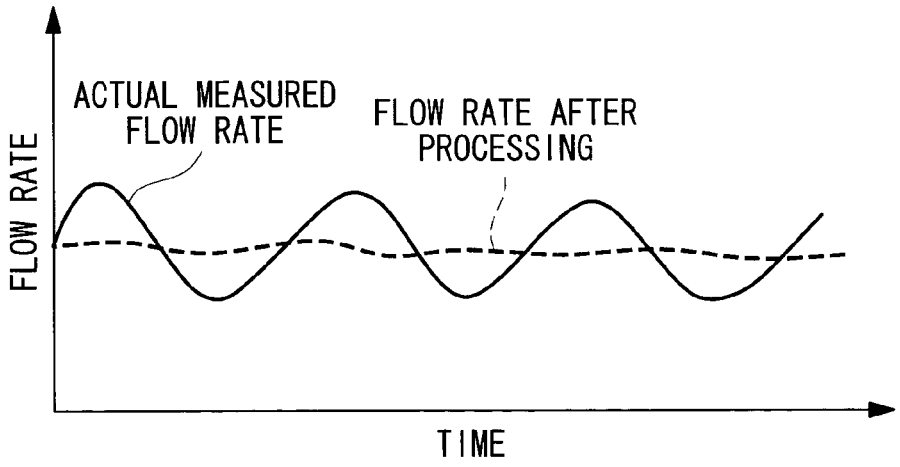
FIG. 7 is a diagram showing flow rate fluctuations and flow rate after processing.

Furthermore, as shown in FIG. 7, in the case in which flow-rate conditions cannot be obtained with sufficient accuracy for the heating medium or the cooling water due to flow-rate fluctuations, the flow rate of the chilled water or the cooling water, which has a smaller fluctuation range, may be obtained by using the heat-balance relational expression above. Accordingly, stable flow rate values can be obtained as indicated by a dotted line in FIG. 7.

As has been described above, with a centrifugal chiller according to this embodiment, by using the heat-balance relational expression, a sufficiently accurate flow rate can be obtained even when a failure has occurred in the sensor for the cooling water or the sensor for the heating medium.

REFERENCE SIGNS LIST

11*a*, 11*b*, 11*c* centrifugal chiller
20 centrifugal compressor
21 condenser
26 evaporator
51, 61 storage portion
52 chilled-water flow-rate computing portion
53, 63 fault judging portion
54, 65 operating-state determining portion
55, 66 control-command computing portion
56, 67 control-command correcting portion
62 brine-concentration computing portion
521 first computing portion
522 second computing portion

The invention claimed is:

1. A heat source device comprising:
a first heat exchanger that cools or heats a heating medium that flows in from an external load;
a second heat exchanger that performs heat exchange with external air or cooling water;
a refrigerant circulating channel that circulates refrigerant between the first heat exchanger and the second heat exchanger;
a centrifugal compressor provided in the refrigerant circulating channel;
a differential-pressure measuring unit that measures a differential pressure between an inlet pressure and an outlet pressure of the heating medium in the first heat exchanger; and
a controlling unit,
wherein the controlling unit comprises:
a flow-rate computing unit that calculates a flow rate of the heating medium in the first heat exchanger on the basis of the coefficient of loss for the first heat exchanger and the differential pressure output from the differential-pressure measuring unit;
a control-command computing unit that generates a control command by using a specification heating-medium flow rate that is set in advance; and
a control-command correcting unit that corrects the control command generated by the control-command computing unit on the basis of the difference between the heating-medium flow rate calculated by the flow-rate computing unit and the specification heating-medium flow rate;
wherein the controlling unit is configured to control at least the centrifugal compressor using the control command corrected by the control-command correcting unit.

2. The heat source device according to claim 1, wherein the controlling unit further comprises:
a fault judging unit that judges whether or not the difference between the heating-medium flow rate calculated by the flow-rate computing unit and the specification heating-medium flow rate is equal to or greater than a predetermined threshold, which is set in advance, and for issuing an alarm, if the difference is equal to or greater than the threshold, to a monitoring device connected thereto via a communication line.

3. The heat source device according to claim 2, wherein the flow-rate computing unit comprises:

a first computing unit that computes the heating-medium flow rate by using sampling data from the differential-pressure measuring unit; and a second computing unit that applies smoothing processing on the sampling data from the differential-pressure measuring unit and for computing the heating-medium flow rate by using the smoothed sampling data, wherein the fault judging unit performs fault judgment by using the heating-medium flow rate calculated by the first computing unit, and the control-command correcting unit corrects the control command by using the heating-medium flow rate calculated by the second computing unit.

4. The heat source device according to claim 1, wherein, when the differential-pressure measuring unit has failed or a detection limit of the differential-pressure measuring unit has been exceeded, the controlling unit calculates an amount of heat exchanged at the first heat exchanger by substituting current power consumption at the centrifugal compressor and the amount of heat exchanged at the second heat exchanger into a relational expression that expresses the relationship between the power consumption at the centrifugal compressor, the amount of heat exchanged at the first heat exchanger, and the amount of heat exchanged at the second heat exchanger, and calculates the heating-medium flow rate on the basis of the calculated amount of heat exchanged at the first heat exchanger.

5. The heat source device according to claim 1, wherein the controlling unit includes a relational expression in which the relationship between the heating-medium flow rate and the performance of the heat exchanger is expressed and includes unit of determining the performance of the heat exchanger for the heating-medium flow rate calculated by the flow-rate computing unit on the basis of the relational expression and for detecting a performance deterioration of the heat exchanger.

6. The heat source device according to claim 2, wherein, when the differential-pressure measuring unit has failed or a detection limit of the differential-pressure measuring unit has been exceeded, the controlling unit calculates an amount of heat exchanged at the first heat exchanger by substituting current power consumption at the centrifugal compressor and the amount of heat exchanged at the second heat exchanger into a relational expression that expresses the relationship between the power consumption at the centrifugal compressor, the amount of heat exchanged at the first heat exchanger, and the amount of heat exchanged at the second heat exchanger, and calculates the heating-medium flow rate on the basis of the calculated amount of heat exchanged at the first heat exchanger.

7. The heat source device according to claim 3, wherein, when the differential-pressure measuring unit has failed or a detection limit of the differential-pressure measuring unit has been exceeded, the controlling unit calculates an amount of heat exchanged at the first heat exchanger by substituting current power consumption at the centrifugal compressor and the amount of heat exchanged at the second heat exchanger into a relational expression that expresses the relationship between the power consumption at the centrifugal compressor, the amount of heat exchanged at the first heat exchanger, and the amount of heat exchanged at the second heat exchanger, and calculates the heating-medium flow rate on the basis of the calculated amount of heat exchanged at the first heat exchanger.

8. The heat source device according to claim 2, wherein the controlling unit includes a relational expression in which the relationship between the heating-medium flow rate and the performance of the heat exchanger is expressed and includes unit of determining the performance of the heat exchanger for the heating-medium flow rate calculated by the flow-rate computing unit on the basis of the relational expression and for detecting a performance deterioration of the heat exchanger.

9. The heat source device according to claim 3, wherein the controlling unit includes a relational expression in which the relationship between the heating-medium flow rate and the performance of the heat exchanger is expressed and includes unit of determining the performance of the heat exchanger for the heating-medium flow rate calculated by the flow-rate computing unit on the basis of the relational expression and for detecting a performance deterioration of the heat exchanger.

10. The heat source device according to claim 4, wherein the controlling unit includes a relational expression in which the relationship between the heating-medium flow rate and the performance of the heat exchanger is expressed and includes unit of determining the performance of the heat exchanger for the heating-medium flow rate calculated by the flow-rate computing unit on the basis of the relational expression and for detecting a performance deterioration of the heat exchanger.

11. The heat source device according to claim 1, wherein the flow-rate computing unit calculates the flow rate of the heating medium in the first exchanger on the basis of the coefficient of loss for the first heat exchanger, the differential pressure output from the differential-pressure measuring unit, and a correction term on the basis of the amount of liquid held in the first exchanger.

12. The heat source device according to claim 1, wherein the controlling unit is configured to control the heat source device, and wherein the control-command computing unit generates the control command for rotational speed of the centrifugal compressor.

* * * * *